US008608878B2

(12) United States Patent
Kellett et al.

(10) Patent No.: US 8,608,878 B2
(45) Date of Patent: Dec. 17, 2013

(54) SLOW BURNING HEAT GENERATING STRUCTURE

(75) Inventors: Richard M. Kellett, Palmer, CT (US); David F. Irwin, Simsbury, CT (US)

(73) Assignee: Ensign-Bickford Aerospace & Defense Company, Simsbury, CT (US)

( * ) Notice: Subject to any disclaimer, the term of this patent is extended or adjusted under 35 U.S.C. 154(b) by 0 days.

(21) Appl. No.: 12/877,699

(22) Filed: Sep. 8, 2010

(65) Prior Publication Data

US 2012/0055594 A1 Mar. 8, 2012

(51) Int. Cl.

| | |
|---|---|
| ***C06B 45/00*** | (2006.01) |
| ***C06B 45/18*** | (2006.01) |
| ***C06B 45/30*** | (2006.01) |
| ***C06B 45/32*** | (2006.01) |
| ***C06B 45/12*** | (2006.01) |
| ***C06B 45/14*** | (2006.01) |

(52) U.S. Cl.
USPC ..... 149/15; 149/2; 149/3; 149/5; 149/6; 149/14

(58) Field of Classification Search
USPC ..... 149/108.6, 2, 3, 5, 6, 14, 15
See application file for complete search history.

(56) References Cited

U.S. PATENT DOCUMENTS

| | | | | |
|---|---|---|---|---|
| 3,086,894 A | | 4/1963 | Baggett et al. | |
| 3,111,396 A | | 11/1963 | Ball | |
| 3,188,210 A | * | 6/1965 | Gerhard et al. | 430/193 |
| 3,319,520 A | | 5/1967 | Stefano et al. | |
| 3,430,564 A | | 3/1969 | Silvia et al. | |
| 3,503,814 A | * | 3/1970 | Helms, Jr. et al. | 149/37 |
| 3,509,822 A | | 5/1970 | Rice et al. | |

(Continued)

FOREIGN PATENT DOCUMENTS

| | | |
|---|---|---|
| DE | 102006001838 | 7/2007 |
| GB | 2224729 | 5/1990 |

(Continued)

OTHER PUBLICATIONS

Miziolek, Andrzej: "Nanoenergetics: An Emerging Technology Area of National Importance", The Amptiac Newsletter, vol. 6, No. 1, Spring 2002.

(Continued)

*Primary Examiner* — James McDonough
(74) *Attorney, Agent, or Firm* — O'Shea Getz P.C.

(57) ABSTRACT

A heat generating structure includes a substrate, a coating and a polymeric material. The substrate comprises a first material. The coating comprises a second material, different from the first material that covers at least a portion of the substrate. The coating and substrate, upon being thermally energized to their minimum alloying temperature, react in a first exothermic reaction that is an alloying reaction. The relative quantities of the substrate and coating are such that the first exothermic reaction yields a first amount of exothermic energy that is insufficient to cause self-sustained propagation of the first exothermic reaction. The polymeric material covers substantially all of the substrate and coating, and is different from the first and second materials. The polymeric layer, upon being thermally energized, reacts with at least one of the substrate and coating in a second exothermic reaction. The second exothermic reaction yields a second amount of exothermic energy that, when combined with the first amount of exothermic energy, is sufficient to propagate the first exothermic reaction in a self-sustained manner.

9 Claims, 4 Drawing Sheets

(56) References Cited

U.S. PATENT DOCUMENTS

| | | | | | |
|---|---|---|---|---|---|
| 3,730,093 | A | | 5/1973 | Cummings | |
| 3,744,427 | A | * | 7/1973 | Good et al. | 102/285 |
| 3,768,409 | A | | 10/1973 | Menz et al. | |
| 4,053,337 | A | | 10/1977 | Collins | |
| 4,101,352 | A | * | 7/1978 | Poulin et al. | 149/19.2 |
| 4,349,612 | A | | 9/1982 | Baldi | |
| 4,429,632 | A | | 2/1984 | Yunan | |
| 4,696,231 | A | | 9/1987 | Bryan | |
| 4,815,386 | A | | 3/1989 | Dillard et al. | |
| 5,031,538 | A | * | 7/1991 | Dufrane et al. | 102/275.5 |
| 5,046,425 | A | | 9/1991 | Gibbons, Jr. et al. | |
| 5,182,417 | A | | 1/1993 | Rontey et al. | |
| 5,495,819 | A | | 3/1996 | Marion | |
| 5,547,715 | A | | 8/1996 | Barbee et al. | |
| 5,843,538 | A | * | 12/1998 | Ehrsam et al. | 427/601 |
| 6,006,671 | A | | 12/1999 | Yunan | |
| 6,010,610 | A | | 1/2000 | Yih | |
| 6,170,398 | B1 | | 1/2001 | Rabotinsky et al. | |
| 6,863,992 | B2 | | 3/2005 | Weihs et al. | |
| 6,886,327 | B1 | | 5/2005 | Nathal et al. | |
| 7,383,775 | B1 | | 6/2008 | Mock, Jr. et al. | |
| 2004/0244890 | A1 | | 12/2004 | Cesaroni et al. | |
| 2005/0067072 | A1 | | 3/2005 | Vavrick | |
| 2005/0142404 | A1 | | 6/2005 | Boucher et al. | |
| 2007/0202304 | A1 | * | 8/2007 | Golovko et al. | 428/195.1 |
| 2009/0031911 | A1 | | 2/2009 | Kellett et al. | |
| 2009/0090440 | A1 | * | 4/2009 | Kellett | 149/9 |

FOREIGN PATENT DOCUMENTS

| | | |
|---|---|---|
| WO | 9424074 | 10/1994 |
| WO | 2004106268 | 12/2004 |
| WO | 2006086274 | 8/2006 |
| WO | 2007/095303 | 8/2007 |

OTHER PUBLICATIONS

Fischer et al.: "A Survey of Combustible Metals, Thermites and Intermetallics for Pyrotechnic Applications", Joint Propulsion Conference and Exhibit, July 103, 1996.

Fischer et al.: "Theoretical Energy Release of Thermites, Intermetallics, and Combustible Metals", 24th International Pyrotechnics Seminar, Jul. 1998.

Sigmund Cohn Corp.: "Pyrofuze", www.sigmundcohn.com.

Reactive NanoTechnologies: "RNT NanoFoil product", www.rntfoil.com.

* cited by examiner

SLOW BURNING HEAT GENERATING STRUCTURE

BACKGROUND OF THE INVENTION

The invention relates in general to heat generating structures, and more particularly to a relatively slow burning, heating element that may be utilized for various purposes such as a delay element or fuse that ignites an explosive device or material.

It is known that a heat generating structure composed of two dissimilar materials such as metals may be used as an ignitable delay element or fuse structure. The delay element may be used in varied applications to safely initiate the timed ignition or detonation of an explosive device or material. These heat generating structures can come in many different physical forms. For example, ignitable delay elements can be made of a compressed powder mixture. Other known heat generating structures that can be used as delay elements include a metallic device that is commercially available under the brand name Pyrofuze® provided by the Sigmund Cohn Corporation of Mount Vernon, N.Y. This device comes in wire or ribbon form and comprises two metallic elements in intimate contact with one another: an inner core of aluminum surrounded by an outer jacket of palladium. When the two metallic elements are brought to the initiating temperature by a sufficient amount of heat, the metals react by alloying rapidly resulting in instant deflagration without support of oxygen. Once the alloying reaction is started, the reaction will not stop until alloying is completed. Hence, a drawback with the Pyrofuze® delay element is that it typically burns at a relatively rapid rate.

Another commercially available heat generating structure that can be used as a delay element or fuse is provided under the brand name NanoFoil® by Reactive NanoTechnologies, Inc. of Hunt Valley, Md. The NanoFoil® device is a multilayer foil comprised of thousands of alternating nanoscale thin layers of aluminum and nickel. When initiated by an electrical, thermal, mechanical or optical source, the metals will mix or alloy and react to release heat energy. However, when used as a delay element or fuse, the NanoFoil® multilayer foil tends to have a burn rate that is relatively fast, and the burn rate is not easily variable. The NanoFoil® multilayer foil is also relatively expensive.

What is needed is a relatively slow burning, gasless, heat generating structure composed of two or more dissimilar materials, such as metals, distributed in a non-uniform three-dimensional manner along its propagation or burn path, where the structure is flexible and not subject to cracking, and when ignited exhibits an exothermic alloying reaction between the materials and can function as a delay element or fuse in providing for reliable propagation and, thus, accurate ignition of an explosive device.

SUMMARY OF THE INVENTION

According to an aspect of the invention, a heat generating structure includes a substrate, a coating and a polymeric material. The substrate comprises a first material. The coating comprises a second material that is different from the first material. The coating covers at least a portion of the substrate. The coating and substrate, upon being thermally energized to their minimum alloying temperature, react in a first exothermic reaction that is an alloying reaction. The relative quantities of the substrate and coating are such that the first exothermic reaction yields a first amount of exothermic energy, where the first amount of exothermic energy is insufficient to cause self-sustained propagation of the first exothermic reaction. The polymeric material covers substantially all of the substrate and coating. The polymeric material is different from the first material and the second material. The polymeric layer, upon being thermally energized, reacts with at least one of the substrate and coating in a second exothermic reaction. The second exothermic reaction yields a second amount of exothermic energy. The second amount of exothermic energy, when combined with the first amount of exothermic energy, is sufficient to propagate the first exothermic reaction in a self-sustained manner, thus enabling uninterrupted propagation from a first location within the structure along a travel path to a second location within the structure.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
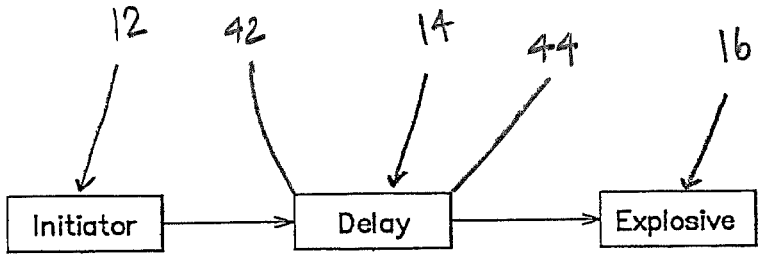
FIG. 1 is a block diagram of a delay element or fuse used between an initiator device and an explosive material or device.
Figure 2:
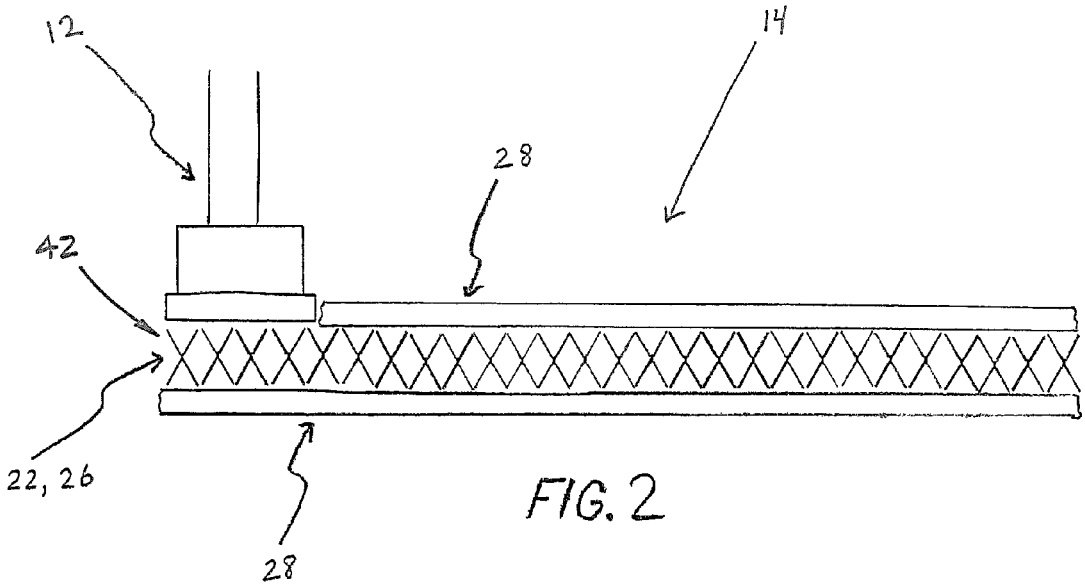
FIG. 2 is a side view of a delay element or fuse connected to an initiator device.

Referring to FIG. 1, a simplified block diagram illustrates an initiator device 12 connected with a delay element 14 (sometimes referred to as a "fuse structure"), which itself is connected with an explosive material or device 16. The explosive device 16 may comprise any type of explosive device or material designed to detonate to achieve a desired purpose. The delay element 14 allows one to initiate the timing of the detonation of the explosive device 16 after a predetermined amount of time following initiation of the delay element 14 using the initiator device 12. The initiator device 12 may be any type of device that provides for initiation of propagation or burning of the delay element 14; for example, the initiator device 12 may comprise an electrical, thermal, mechanical, optical or other device. FIG. 2 shows a side view of a preferred embodiment of a delay element 14 connected to an initiator device 12. As indicated above, the present invention is directed toward a heat generating structure that can be used as a delay element, but which is not limited to such use.

Figure 3:
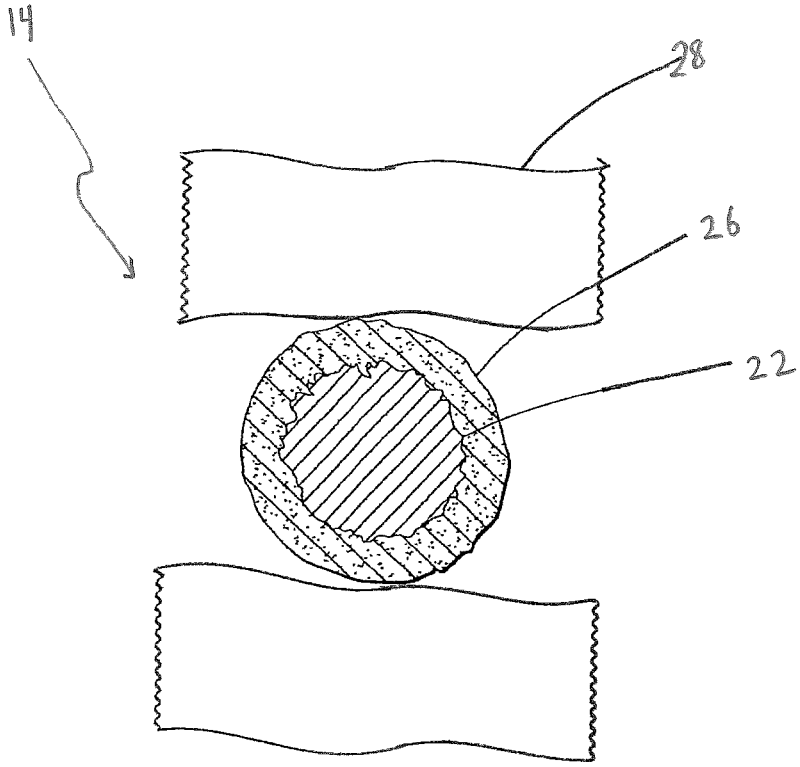
FIG. 3 is a cross-section of one of the wires in a delay element or fuse.
Figure 4:
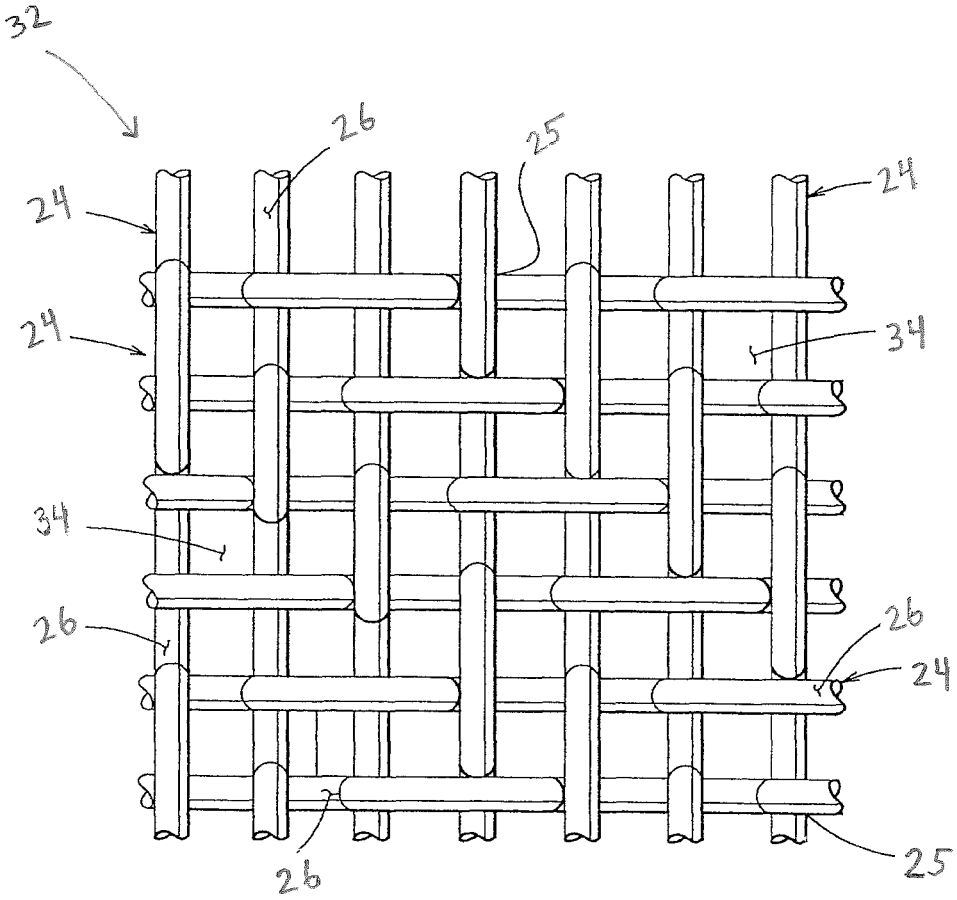
FIG. 4 is a top view of a mesh substrate having a plurality of wires each coated with a material.

Referring to FIGS. 3 and 4, a cross-section of a preferred embodiment of a delay element 14 is shown. The structure of the delay element 14 includes at least three constituent portions: a substrate 22 having a plurality of intra-dispersed empty spaces (e.g., a mesh of wires 24) of a first material, a coating 26 of a second material, and a polymeric layer 28. The three-dimensional structure of the substrate 22 is configured to have an appreciable amount of free volume (i.e., empty air space creating voids 34 between crossing wires in the mesh substrate 22). The substrate 22 is a reactive material continuous or contiguous in three dimensions. The coating 26 is a reactive metal that is different from the material comprising the substrate 22. The polymeric layer 28 is preferably a fluorinated or perfluorinated polymer that shrouds substantially all of the substrate 22 and coating 26. In the embodiment shown in FIG. 4, the substrate 22 is a continuous mesh structure 32, having a plurality of intersecting straight metal wires 24 with empty spaces 34 located between intersecting wires 24. The wires 24 are in intimate physical and, thus thermal, contact with one another at the intersections 25 within the mesh structure 32. An example of an acceptable mesh structure 32 is one commercially available from TWP, Inc. of Berkeley, Calif., that consists of a mesh of aluminum wires 24 each with an approximate thickness or diameter in the range of from 0.0021 inches (200 wires per inch) to 0.0090 inches (40 wires per inch). The present invention is not limited to this example, however. As used herein, the term "aluminum" includes pure aluminum as well as aluminum alloys that consist nominally of aluminum. As described in the U.S. Patent Application Publication No. 2009/0031911 (hereinafter "the '911 Publication"), which is herein incorporated by reference in its entirety, the substrate 22 may alternatively comprise a foam substrate 22 or other non-completely-solid substrate 22, and may alternatively comprise various metals (e.g., magnesium, boron, beryllium, zirconium, titanium, tantalum, hafnium, or zinc). In an alternative embodiment, the substrate 22 can be formed from a polymer matrix arranged as described above with empty spaces, which matrix includes metal particles. Such polymer matrices can include materials such as polytetrafluoroethylene, fluoroelastomers, fluorosurfactants, fluoroadditives, hydroxy teiininated polybutadiene, hydroxy terminated polyether, carboxy terminated polybutadiene, polyether, polycaprolactone, polyvinyl chloride, glycidyl azide polymer, polyoxetanes, or polyglycidyl nitrate. In yet another alternative embodiment, the substrate 22 can be formed using "wires" in a mesh structure, which wires consist of a metallic (e.g., aluminum) tube filled with the aforesaid polymer matrix. For ease of description, the substrate 22 will be described herein after as a mesh-type structure formed from wires 24.

The coating 26 is applied on at least a portion of each substrate wire 24, and preferably on the entirety of each substrate wire 24, to thereby form a substrate 22 of continuously-coated wires 24. As will be described below, the material of the coating 26 is chosen based on its characteristics and the characteristics of the substrate 22. Examples of acceptable coating materials include nickel, palladium, and alloys of either; e.g., the nickel coating 26 may include other materials including boron, phosphorus and/or palladium, or other metals, such as rhenium, that improve ductility. In those instances where the coating includes nickel with some amount of boron and/or phosphorous, the nickel alloy typically includes 0-15% by weight of boron, phosphorus, or some combination thereof.

The materials (e.g., metals) comprising the substrate 22 and the coating 26 are selected based on their individual characteristics (e.g., melting point and density), and based on the formation enthalpy of their alloys. Also, for reasons discussed further below, the materials comprising the substrate 22 and the coating 26 are selected such that the alloying reaction between the materials is highly exothermic. In a preferred embodiment, the substrate 22 is an aluminum mesh and the coating 26 is a nickel material. The nickel coating 26 may be applied onto the outer surface of each of the wires 24 of the aluminum substrate 22 by, for example, electroplating or other deposition methods such as vacuum sputtering or an electrochemical process or by mechanical means such as swaging If aluminum is utilized as the substrate 22 material, any aluminum oxide that is present on the outer surface of the aluminum wires 24 prior to coating 26 deposition may be removed and a layer of zinc may be applied to the outer surface of the wires 24 prior to the deposition of the coating 26 (e.g., nickel). The layer of zinc may allow ignition of the delay element 14 at a lower temperature than if the layer of zinc were not present. The layer of zinc is not required, however.

An exothermic alloying reaction is initiated when the substrate 22 and coating 26 are subjected to an ignition source (e.g., a match or heating element) adequate to bring the substrate 22 and coating 26 to its minimum alloying temperature. Alloying reactions may in some instances propagate in a self-sustained manner if the alloying reaction between the materials is sufficiently exothermic. The degree to which an exothermic reaction may take place will depend, in part, on the materials used and the relative quantities thereof The '911 Publication discloses a delay element comprising an aluminum substrate 22 and a nickel coating 26, configured to produce a self-sustained propagating alloying reaction.

According to the present invention, the relative molar contents of the substrate 22 and coating 26 are such that the molar content of the coating 26 is less than the molar content of the substrate 22 for a given cross-section of the delay element 14. A relatively thin coating 26 gives the delay element 14 greater flexibility and makes the coating 26 less susceptible to cracking, which in turn makes the delay element 14 easier to work with and gives it greater utility. Using the above-described aluminum mesh substrate 22 and nickel coating 26 as an example, the molar content of the nickel 26 coating is chosen to be less than the molar content of the aluminum substrate 22. In fact, the molar content of the nickel coating 26 is purposefully chosen to be sufficiently low relative to the molar content of the aluminum substrate 22 that the alloying reaction between the substrate 22 and the coating 26 alone is unable to propagate in a self-sustained manner The propagation cannot self sustain because the exothermic energy developed by the quantity of nickel coating 26 alloying with the aluminum substrate 22 is insufficient to maintain the alloying reaction.

Because the aluminum substrate 22 and nickel coating 26, by themselves, cannot propagate in a self-sustained manner, the structure of the present invention further includes a polymeric layer 28 that enables self-sustained propagation. The substrate 22 and coating 26 are embedded or shrouded by the polymeric layer 28, which is in intimate physical and, thus thermal, contact therewith. The polymeric layer 28 preferably comprises a fluorinated or perfluorinated polymer; e.g., fluoroelastomers, fluorosurfactants, fluorinated organic substances, etc. An example of an acceptable polymeric layer 28 is a commercially available polytetrafluoroethylene tape ("PFTE tape"). The polymeric layer 28 enables self-sustaining propagation of the delay element 14 structure by reacting with the substrate 22 (e.g., aluminum) and/or coating 26 (e.g., nickel), and also may react with the alloyed material resulting from the alloying reaction between the substrate 22 and the coating 26. The chemical reaction between the polymeric layer 28 and aluminum substrate 22 can be expressed by the following equation:

$$2n\mathrm{Al}+3[-(\mathrm{CF}_2)_n-]\rightarrow 2n\mathrm{AlF}_3+3n\mathrm{C}$$

where "n" is a number of molecules. In this chemical reaction, additional thermal energy is evolved, which energy sustains propagation of the exothermic alloying reaction between the aluminum substrate 22 and the nickel coating 26. In terms of a delay element 14 structure, the self-sustaining reaction may be described as propagating from a first point 42 (i.e., a starting point) within the delay element 14 structure and along a travel path to a second point 44 (i.e., a discharge point) within the delay element 14 structure, and preferably in a controlled and repeatedly manufacturable manner. For example, if the delay element 14 structure is of a three-dimensional, rectangular-shape, once ignited at a first point 42 of the delay element 14 structure, the thermal energization of the substrate 22, coating 26, and polymeric layer 28 comprising the delay element 14 structure will cause the propagation to continue through to the second point 44 at a consistent timed rate depending on the composition of the substrate 22, coating 26, and polymeric layer 28, as well as on the geometric configuration (e.g., thickness of wires, wire crossing frequency) of the delay element 14 structure. Located at the second point 44 of the delay element 14 structure can be some type of explosive material or device 16 (e.g., fireworks, blasting caps, etc.) that is ignited when the propagation reaches the second point 44 of the delay element 14 structure. Thus, by controlling the composition and the configuration of the reactive materials comprising the delay element 14, the propagation rate can be controlled (that is, the reaction rate or time period for propagation from the first point 42 to the second point 44 along the travel path of the reactive material can be selected). The propagation rate may alternatively be controlled by altering the three-dimensional characteristics of the substrate 22. One of the advantages of the present invention heat generating structure is that the polymeric material is a relatively poor heat transfer medium. As a result, the exothermic energy developed during the exothermic reaction is impeded from transferring away from the reaction site, and is therefore available to facilitate the propagation of the reaction. For this reason, the polymeric material may be described as having a "thermal insulative" quality that facilitates the propagation of the exothermic reaction even when surrounded and in contact with metals or other thermal conductors.

Although the present invention has been illustrated and described with respect to several preferred embodiments thereof, various changes, omissions and additions to the form and detail thereof, may be made therein, without departing from the spirit and scope of the invention. For example, the present invention has been described as a heat generating structure that includes a substrate, a coating applied to the substrate, and a polymeric material covering substantially all of the substrate and coating. The aforesaid structure can be used in a variety of different configurations (e.g., folded over, stacked, etc.) for use in different applications.

What is claimed is:

1. A heat generating structure, comprising:

a substrate comprised of a first material and where the first material is in the form of a mesh or a foam;

a coating comprised of a second material that is different from the first material, where the coating covers at least a portion of the substrate;

wherein the coating and substrate, upon being thermally energized to their minimum alloying temperature, react in a first exothermic reaction that is an alloying reaction, where the relative quantities of the substrate and coating are such that the first exothermic reaction yields a first amount of exothermic energy, where the first amount of exothermic energy is insufficient to cause self-sustained propagation of the first exothermic reaction; and a polymeric material covering substantially all of the substrate and coating, where the polymeric material is different from the first material and the second material, where the polymeric layer, upon being thermally energized, reacts with at least one of the substrate and coating in a second exothermic reaction, where the second exothermic reaction yields a second amount of exothermic energy, where the second amount of exothermic energy, when combined with the first amount of exothermic energy, is sufficient to propagate the first exothermic reaction in a self-sustained manner, thus enabling uninterrupted propagation from a first location within the structure along a travel path to a second location within the structure.

2. The structure of claim 1, where the first material comprises aluminum and the second material comprises nickel.

3. The structure of claim 1, where the first material comprises aluminum and the second material comprises palladium.

4. The structure of claim 1, where the first material comprises aluminum and the second material comprises nickel with 0-15% by weight of boron, phosphorus, or some combination thereof.

5. The structure of claim 1, where the first material is selected from the group consisting of aluminum, magnesium, boron, beryllium, zirconium, titanium, tantalum, hafnium, and zinc.

6. The structure of claim 1, wherein the polymeric material is substantially fluorinated or a perfluorinated polymer or contains fluoroelastomers, fluorosurfactants, or fluorinated organic substances.

7. The structure of claim 1, wherein the polymeric material is a polytetrafluoroethylene film or tape.

8. The structure of claim 1, wherein at least some of the reaction between the first material and the polymeric material is expressed with the following equation:

$$2n\mathrm{Al}+3[-(\mathrm{CF}_2)_n-]\rightarrow 2n\mathrm{AlF}_3+3n\mathrm{C}.$$

9. The structure of claim 1, wherein a relative molar content of the coating is less than a relative molar content of the substrate.

* * * * *